US005320563A

United States Patent [19]

Liao

[11] Patent Number: 5,320,563

[45] Date of Patent: Jun. 14, 1994

[54] SAFETY CONSTRUCTION OF RECEPTACLE PLUGS

[76] Inventor: N. W. Liao, 18, Tzu Yu Pin Road, Hsinchu, Taiwan

[21] Appl. No.: 59,388

[22] Filed: May 11, 1993

[51] Int. Cl.[5] ..... H01R 13/68

[52] U.S. Cl. ..... 439/622; 439/910

[58] Field of Search ..... 439/621, 622, 910, 911; 337/198

[56] References Cited

U.S. PATENT DOCUMENTS 4,684,914 8/1987 Wu ..... 337/198

4,904,976 2/1990 Liaq ..... 337/198

*Primary Examiner*—Eugene F. Desmond

*Attorney, Agent, or Firm*—Morton J. Rosenberg; David I. Klein

[57] ABSTRACT

A safety construction of receptacle plugs mainly comprises a housing and an insertion piece; the housing having an inspection port provided on its top, and a cover plate that can be placed into the housing from the rear side of the housing and slides in and out to close the inspection port; the insertion piece having a plurality of troughs arranged thereon that can accommodate two sets of copper conductor plates and two fuses, each set of copper conductor plates including two separated parts connected to each other by way of a fuse that constitutes a safety device. Under the cover plate there is an overhanging separator formed to keep fuses apart to obtain a safety effect.

3 Claims, 9 Drawing Sheets

SAFETY CONSTRUCTION OF RECEPTACLE PLUGS

BACKGROUND OF THE INVENTION

A prior art plug used for Christmas light bulb series is designed to be connected in series to fit for a multitude of light bulb series using. That is, the plug can be attached to a receptacle and in the same time provides another receptacle on its back to which another plug can be attached so that a plurality of light bulb series can use the same power source, which was described in U.S. Pat. No. 4,846,723 and 4,768,979. However, in the two cases there is no protection mechanism for safety. Accordingly, another improved construction was presented in U.S. Pat. No. 4,904,976, in which a fuse is installed in the plug to prevent an overcurrent in light bulb series and a cover is provided on the housing so that people can open the cover to inspect or replace. But, there still exist shortcomings in such a design. For example, the copper conductor plate is a single whole piece with one projecting end used as a copper blade that is to be inserted into another receptacle, and the other end situated inside the housing and used as a connecting portion that is to reach the copper blades of another plug. The fuse connects the copper conductor plates to the light bulb series and so the current still flows to the next plug even when the fuse is burned down, which is apt to incur danger. Additionally, the cover is not easy to open and if the cover is opened but the plug has not been disconnected due to a user's neglect, the danger of an electric shock may happen.

OBJECT OF THE INVENTION

The principal object of the invention is to provide a safety construction of a receptacle plug that has eliminated the above described problems. The safety construction comprises isolated type copper conductor plates connected with fuses therebetween and so when the fuses are burned down, not only the light bulb series but also subsequent receptacles and other light bulb series sets are electrically disconnected to ensure the safety of people.

Another object of the invention is to provide a safety construction of a receptacle plug that can be quickly checked up when the fuses are burnt down.

One another object of the invention is to provide a safety construction of a receptacle plug, in which the cover plate is inserted from the rear side of the housing and can be pulled out from the front to reveal an inspection port, which action can be only performed when the plug has been disconnected from the power source and thus the safety of people can be guaranteed.

The invention will be described hereinafter in detail in conjunction with an exemplary embodiment thereof by referring to the accompanying drawings.

DETAILED DESCRIPTION

Figure 1:
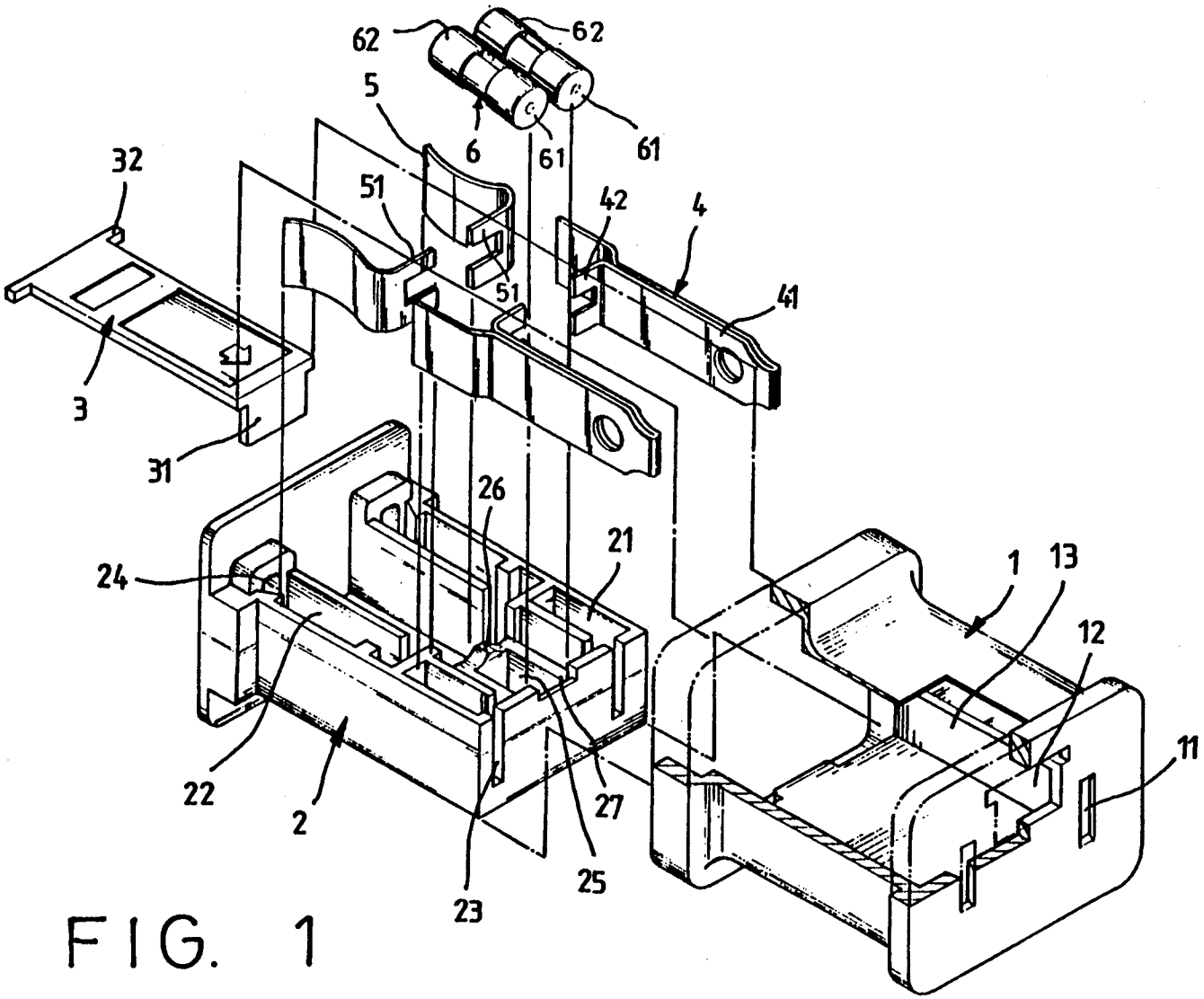
FIG. 1 is an exploded perspective view showing an embodiment of a receptacle plug according to the invention.
Figure 2:
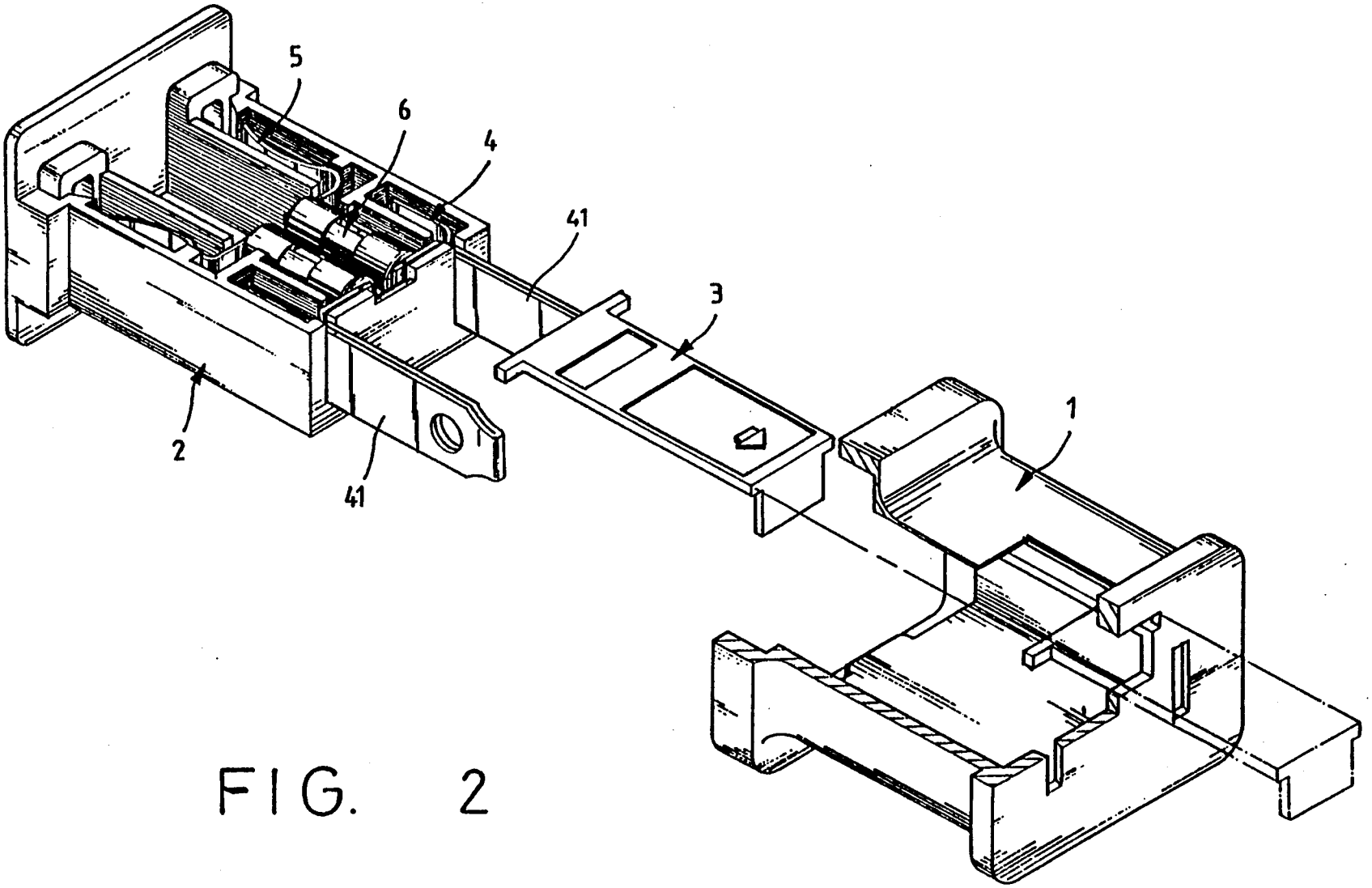
FIG. 2 is an exploded perspective view showing the construction of the preferred embodiment, with some components set in their positions.
Figure 3:
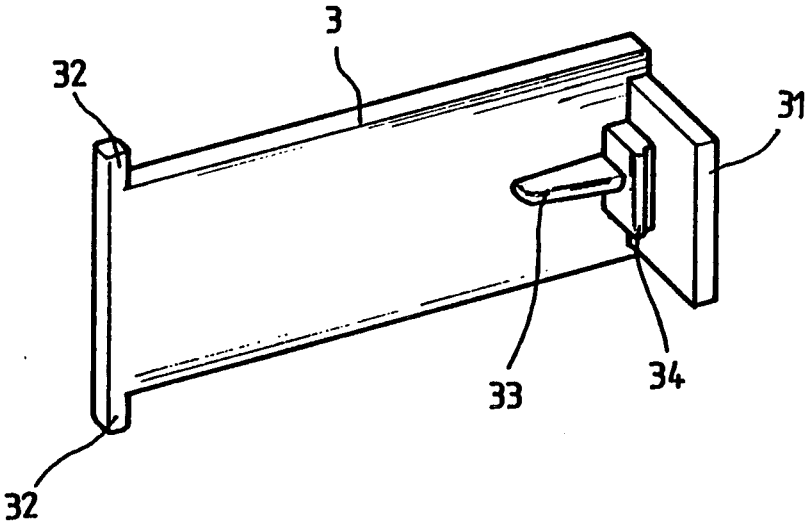
FIG. 3 is a perspective view showing a cover plate of the embodiment.

As can be seen in FIGS. 1 and 2, the receptacle plug of the invention comprises a housing (1) and an insertion piece (2). The housing (1) has two slots (11) formed on the front thereof, a T-shaped opening (12) disposed in its central front portion, an inspection port (13) provided in its top, and a cover plate (3) that has a L-shaped front stop plate (31) and can be placed into the guide slots of the housing (1) from the rear side of the housing until the stop plate (31) being just flush with the T-shaped opening (12). The cover plate (3) has two projecting locating stoppers (32) provided on its rear end which stoppers can keep the cover plate from being completely pulled out of the T-shaped opening (12). Moreover, the stop plate (31) has an overhanging separator (33) (shown in FIG. 3) provided on the upper portion of the inside surface thereof under which separator a raised engaging portion (34) is formed.

Inside the insertion piece (2), there are two front troughs (21) and two rear troughs (22) disposed at two sides; the front troughs (21) having notches (23) arranged on the front wall thereof, and the rear troughs (22) being connected to the outside through openings (24) provided on the rear wall of the insertion piece (2). Besides, two copper conductor plates (4) are respectively arranged in the front troughs (21), with the copper blade portions that project outwards mounted on two notches (23). Two additional conductor connecting pieces (5) are set inside the rear troughs (22). The interior of the insertion piece (2) further contains a recessed portion (25) located in the front central area thereof on the bottom of which recessed portion (25) there is a protrusion (26) situated that divides the recessed portion (25) into two halves for accommodating two fuses (6) therein.

Figure 4:
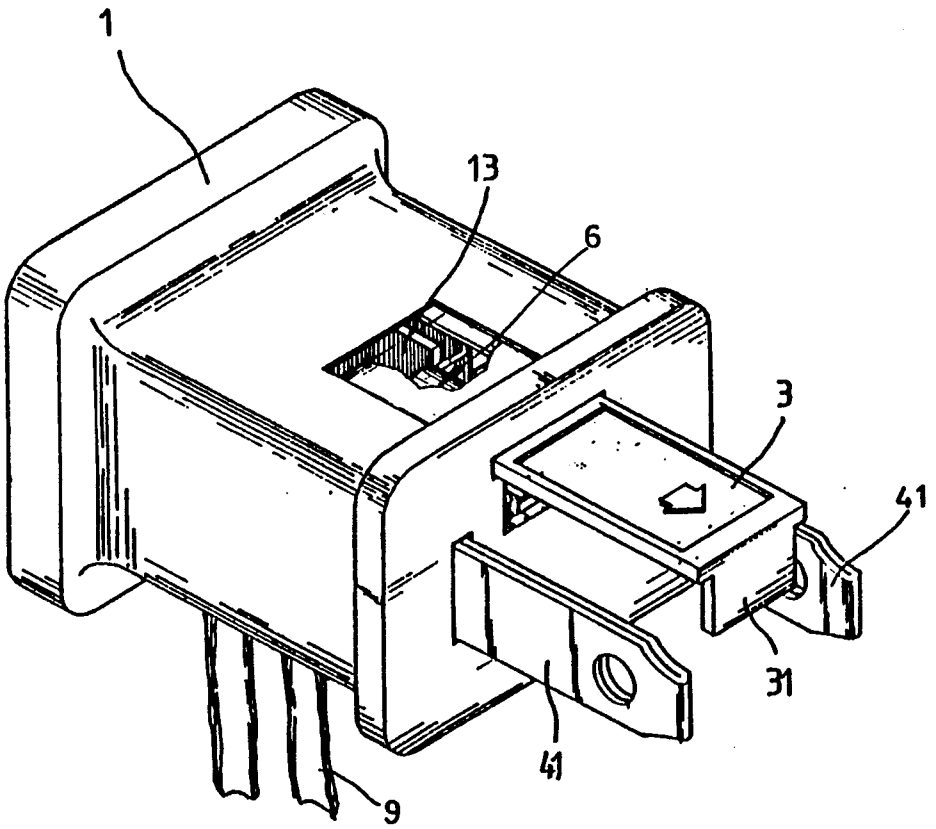
FIG. 4 is a perspective view showing the appearance of the embodiment of FIG. 1 after being assembled.
Figure 5:
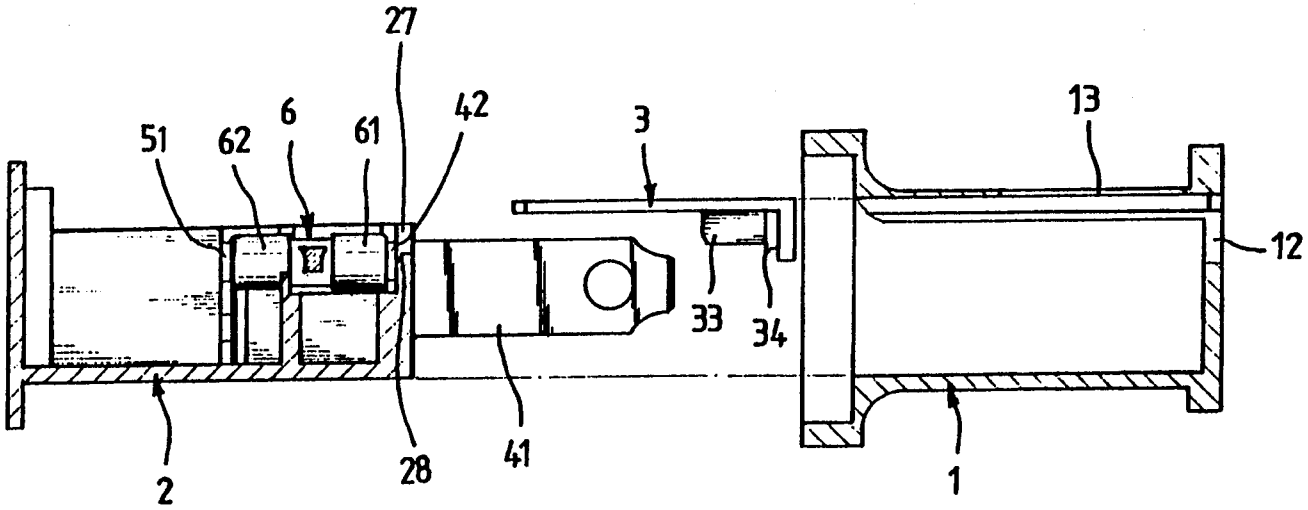
FIG. 5 is a cross-sectional plan view of the receptacle plug.
Figure 6:
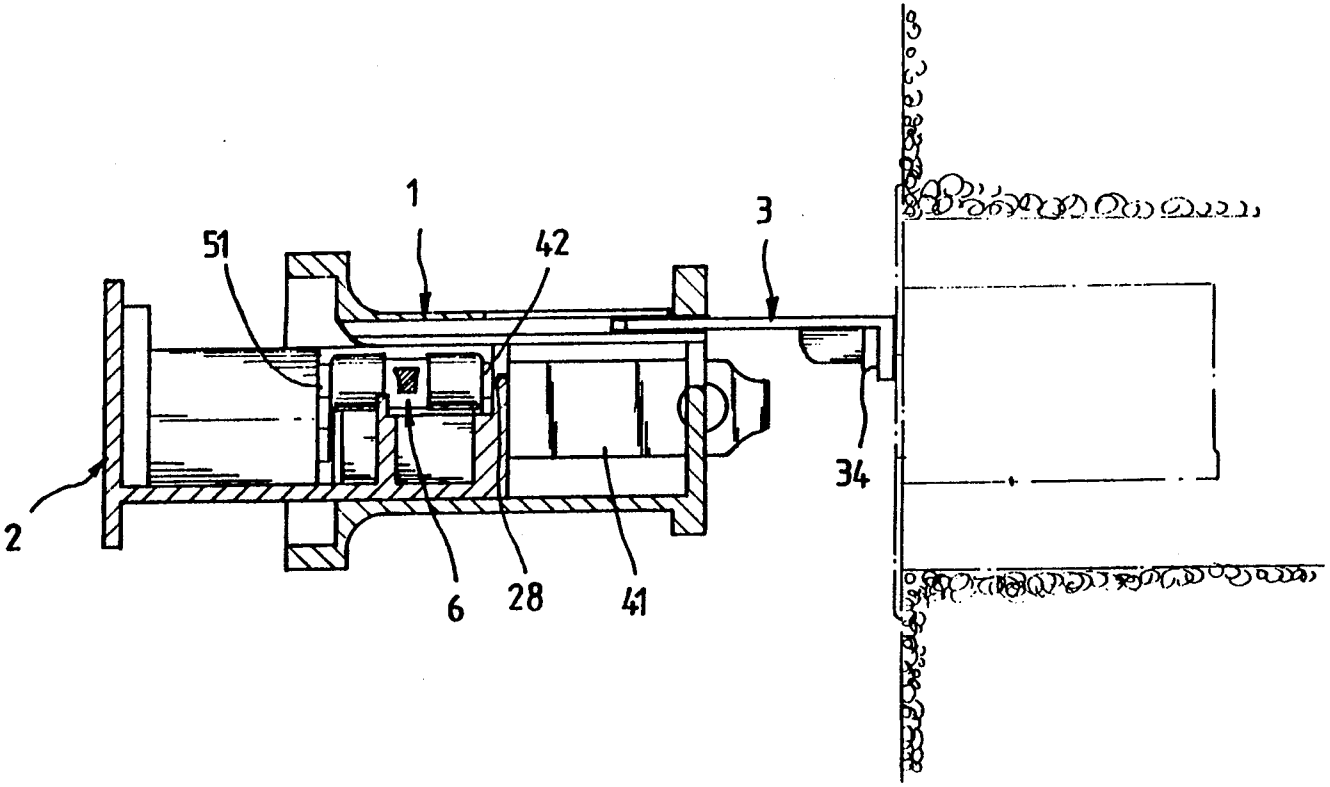
FIG. 6 is a cross sectional view showing a practical application example of the embodiment.

After being combined with other components, the insertion piece (2) can be inserted into the housing from an opening arranged on the rear side of the housing (1) to form an integrated receptacle plug, with two copper blades (41) projecting from the slots (11) as shown in FIG. 4. Now referring to FIGS. 5 to 7, the end caps (61) of fuses (6) do not touch the bent contact segments (42), (52) of copper conductor plates (4) and conductor connecting pieces (5) at the same time before the insertion piece (2) is completely inserted into the housing (1). And thus safety is enhanced. However, because the raised engaging portion (34) situated under the overhanging separator (33) of the cover plate (3) matches with a concave portion (28) formed on the interior edges of the notch (27) located in front of the insertion piece (2), the bent contact segments (42) of the copper conductor plates (4) will be urged to get in touch with the fuses (6) when the insertion piece is combined with the housing correctly and completely and so a connection between fuses and copper plates is accomplished. Furthermore, the overhanging separator (33) will enter the space between two fuses to separate them from each other, which can substantially get an isolation effect.

Figure 7:
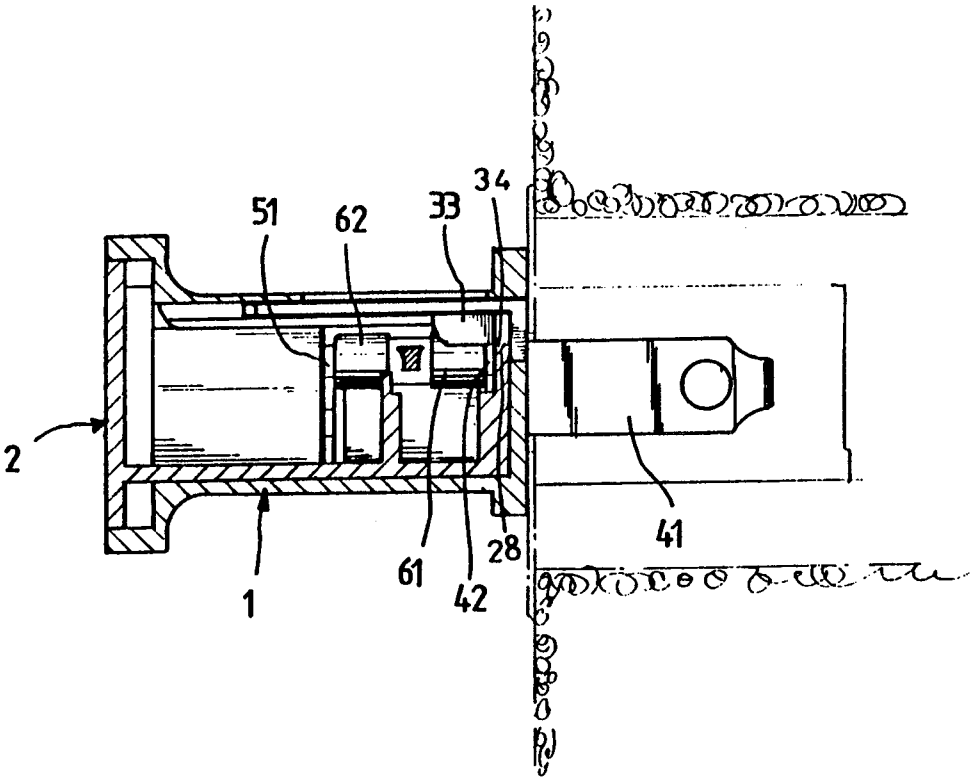
FIG. 7 is another cross sectional view illustrating the function of the cover plate.

In addition, the cover plate (3) is designed to be pulled out from the front so that it cannot be drawn when the plug is attached to a receptacle or outlet (as shown in FIG. 7), which can remind users to disconnect the power line before they examine or replace fuses. As the cover plate (3) is pulled out, fuses are automatically released and thus easy to be taken out. Moreover, the conductor connecting pieces (5) are connected with the copper conductor plate by way of fuses and so the connection will be automatically interrupted when the fuses are burned down, as consequence of which the subsequent receptacle plugs will be electrically disconnected and so safety is improved.

Figure 8:
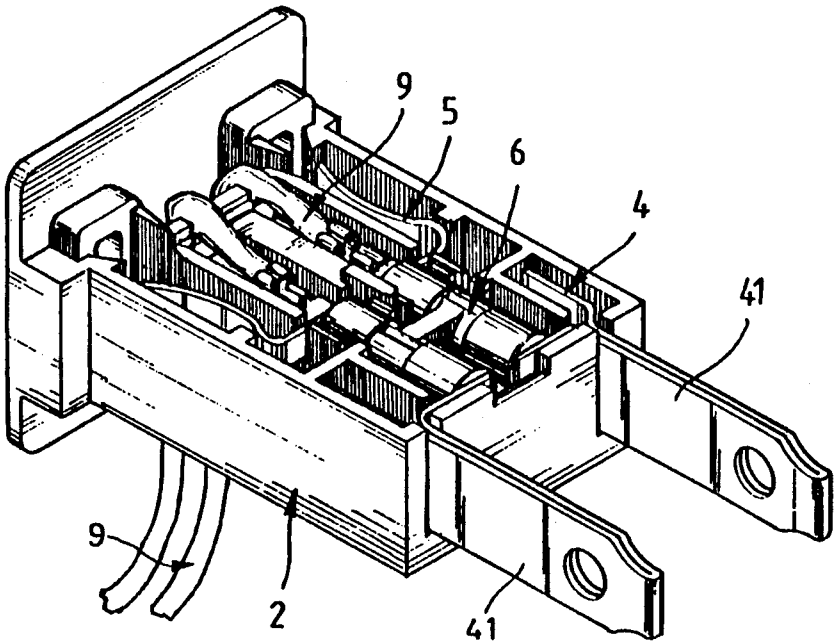
FIG. 8 shows another embodiment of the invention.
Figure 9:
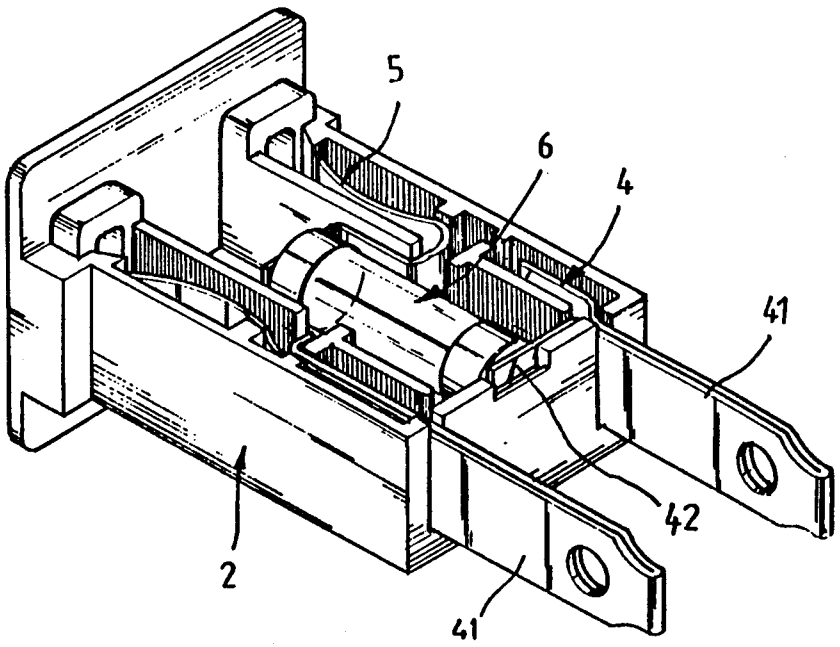
FIG. 9 shows one another exemplary embodiment of the invention.

The invention is not limited to the above-described embodiment, but may include some modifications within the spirit and scope of the invention, for example, FIG. 8 showing another embodiment of the invention in which the conducting wires of light bulb series are incorporated and FIG. 9 showing one another embodiment that uses only one set of isolated type conductor plate and fuse.

What is claimed is:

1. A safety receptacle plug comprising:

(a) a plug housing forming an open plug housing chamber having a top wall and a frontal wall, said top wall having an inspection port formed therethrough, said frontal wall having a centrally located T-shaped opening formed therethrough and a pair of through slots formed on opposing sides of said T-shaped opening;

(b) a cover plate member for slidable insertion within a pair of guide slots formed within said plug housing for covering said inspection port, said cover plate member having a front stop plate for mating engagement with said T-shaped opening, and a pair of transversely extending stop members formed on a rear section of said cover plate member;

(c) an insertion member for insert into said plug housing chamber, said insertion member having a pair of transversely displaced frontal troughs and a pair of transversely displaced rear troughs formed therein, said frontal troughs having a pair of through frontal trough slots for alignment with said plug housing slots, said pair of transversely displaced rear troughs having a pair of through openings formed through a rear wall thereof, said insertion member further including a recess formed between said transversely displaced frontal troughs for insert therein of a pair of fuses, said recess having an insertion member protrusion for dividing said recess into a pair of open compartments for insert of said fuses;

(d) a pair of conductor plates mounted in said pair of frontal troughs in contact with a front end of each of said fuses and projecting through said through frontal trough slots and said plug housing slots; and, (e) a pair of conductor connecting members mounted within said insertion member rear troughs for contact with a rear end of said fuses respectively.

2. The safety plug as recited in claim 1 where said cover plate member includes a separation member extending from a lower surface thereof for insert between said fuses, said separator member having a raised section of predetermined arcuate contour for mating with a predetermined arcuate contour formed on interior edges defining said insertion member through frontal trough slots for urging respective contact segments of said conductor plates into contact with respective front ends of said fuses.

3. The safety plug as recited in claim 1 wherein said transversely extending stop members extend transversely beyond said T-shaped opening thereby capturing said cover plate member within said housing chamber.

* * * * *